US009272509B2

(12) United States Patent
Suzuki

(10) Patent No.: US 9,272,509 B2
(45) Date of Patent: Mar. 1, 2016

(54) PRINTING APPARATUS

(75) Inventor: Takumi Suzuki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 77 days.

(21) Appl. No.: 13/405,586

(22) Filed: Feb. 27, 2012

(65) Prior Publication Data

US 2012/0229538 A1 Sep. 13, 2012

(30) Foreign Application Priority Data

Mar. 9, 2011 (JP) ..... 2011-052119

(51) Int. Cl.
*B41J 29/38* (2006.01)
*B41J 2/045* (2006.01)

(52) U.S. Cl.
CPC ..... *B41J 2/0458* (2013.01); *B41J 2/04543* (2013.01); *B41J 2/04548* (2013.01); *B41J 2/04553* (2013.01); *B41J 2/04563* (2013.01); *B41J 2/04573* (2013.01); *B41J 2/04598* (2013.01)

(58) Field of Classification Search
USPC ..... 347/9–12
See application file for complete search history.

(56) References Cited

U.S. PATENT DOCUMENTS 4,651,173 A 3/1987 Ozawa et al.
4,692,778 A 9/1987 Yoshimura et al.
4,857,943 A 8/1989 Yoshimura et al.
4,884,085 A 11/1989 Ozawa et al.
4,894,668 A 1/1990 Ozawa et al.
4,922,267 A 5/1990 Ozawa et al.
4,959,660 A 9/1990 Suzuki et al.
4,959,666 A 9/1990 Yoshimura et al.
4,962,390 A 10/1990 Yoshimura et al.
4,973,990 A 11/1990 Yoshimura et al.
5,012,260 A 4/1991 Yoshimura et al.
5,223,859 A 6/1993 Yoshimura et al.
5,262,872 A 11/1993 Yoshimura et al.
5,291,224 A 3/1994 Asano et al.
5,355,160 A 10/1994 Ozawa et al.
5,455,616 A 10/1995 Ozawa et al.
5,480,247 A 1/1996 Saikawa et al.
5,506,606 A 4/1996 Saikawa et al.
5,567,069 A 10/1996 Suzuki et al.
5,611,632 A 3/1997 Hiramatsu et al.
5,636,929 A 6/1997 Asano et al.
5,710,587 A 1/1998 Suzuki et al.
5,733,055 A 3/1998 Hiramatsu et al.
5,784,082 A 7/1998 Shinmachi et al.
5,872,581 A 2/1999 Yanagi et al.

(Continued)

FOREIGN PATENT DOCUMENTS

EP 0890439 A2 1/1999
JP S62-160255 7/1987

(Continued)

*Primary Examiner* — Jason Uhlenhake
(74) *Attorney, Agent, or Firm* — Fitzpatrick, Cella, Harper & Scinto

(57) ABSTRACT

A printing apparatus comprises: a printhead, which has a heater board on which heaters are disposed, configured to discharge ink; a transfer unit configured to transfer a discharge image signal to the printhead; and a power supply circuit configured to generate power for heating the heaters. Here, the printhead includes a supply circuit which, based upon the discharge image signal, supplies the heater board with power generated by the power supply circuit.

28 Claims, 11 Drawing Sheets

(56) References Cited

U.S. PATENT DOCUMENTS

| | | | | |
|---|---|---|---|---|
| 5,940,094 | A | 8/1999 | Otsuka et al. | |
| 5,971,525 | A | 10/1999 | Inoue et al. | |
| 6,027,212 | A | 2/2000 | Tanno et al. | |
| 6,065,830 | A | 5/2000 | Hiramatsu et al. | |
| 6,092,892 | A | 7/2000 | Taniguro et al. | |
| 6,169,557 | B1 | 1/2001 | Suzuki et al. | |
| 6,224,181 | B1 * | 5/2001 | Koitabashi | 347/15 |
| 6,260,950 | B1 | 7/2001 | Tanno et al. | |
| 6,293,670 | B1 | 9/2001 | Taniguro et al. | |
| 6,508,533 | B2 | 1/2003 | Tsujimoto et al. | |
| 6,575,568 | B1 | 6/2003 | Hiramatsu et al. | |
| 7,530,653 | B2 * | 5/2009 | Hirayama | 347/9 |
| 7,722,149 | B2 | 5/2010 | Suzuki | |
| 8,398,188 | B2 * | 3/2013 | Nakata | 347/5 |
| 2004/0021719 | A1 * | 2/2004 | Umezawa | 347/14 |
| 2005/0052490 | A1 * | 3/2005 | Shimizu et al. | 347/30 |
| 2007/0052744 | A1 * | 3/2007 | Mitsuki et al. | 347/12 |
| 2009/0027477 | A1 * | 1/2009 | Matsuo | B41J 2/35 347/211 |
| 2009/0051957 | A1 * | 2/2009 | Han et al. | 358/1.14 |

FOREIGN PATENT DOCUMENTS

| | | | |
|---|---|---|---|
| JP | 11-115173 | A | 4/1999 |
| JP | 2001-232772 | | 8/2001 |
| JP | 2002-264307 | | 9/2002 |
| JP | 2006-212823 | | 8/2006 |
| JP | 2009-220287 | | 10/2009 |

* cited by examiner

PRINTING APPARATUS

BACKGROUND OF THE INVENTION

1. Field of the Invention

The present invention relates to a printing apparatus.

2. Description of the Related Art

Printing apparatuses that print information such as text and images on a printing medium are known in the art. Among these is known, for example, a printing apparatus that employs an inkjet printing method for printing using ink. Such a printing apparatus is provided, for example, with a printhead for printing utilizing thermal energy (see Japanese Patent Laid-Open No. 11-115173).

FIG. 11 illustrates an example of the general configuration of a printing apparatus 100 according to the prior art. The printing apparatus 100 is provided with a power supply circuit 101, printhead 102, control circuit 103 and motor 104.

The printhead 102 is provided with one or a plurality of nozzles (orifices) and with a heater for each corresponding nozzle. When voltage is applied to the heater, ink is discharged from the nozzle.

The control circuit 103 generates an image signal [data (a discharge image signal) in a form made to conform to the nozzles of the printhead 102, and a discharge control signal (heating pulse) for controlling the heaters] and transfers the image signal to the printhead 102.

The power supply circuit 101 supplies power to each of these components. The power supply circuit 101 supplies the components with power (VCC) for operating logic circuitry, motor driving power (VM) and head driving power (VH), by way of example. Since the voltage of VH is high in comparison with the voltage of VCC, some time is required for the optimum voltage (a predetermined voltage) to be attained. For this reason, generally voltage is applied to the heaters in synch with mechanical control that precedes discharge of ink. Further, control of the heating pulses is exercised independently of control of VH.

On the side of the printhead 102, it cannot be determined when an image signal will begin and end. It is therefore required that VH be turned on at a timing considerably earlier than that at which the initial discharge image signal is input to the printhead 102. Further, even after all of the heating pulses have been input to the printhead 102, it is necessary to halt the application of voltage to the printhead 102 in synch with other mechanical control operations, etc.

If VH is applied to the printhead 102 while ink is not being discharged from the printhead, wasteful power consumption will occur. Further, if an image signal rendered erroneous by noise or the like is sent to the printhead 102, control for turning on VH will be delayed.

SUMMARY OF THE INVENTION

The present invention provides a technique adapted so that supply of power to a heater board can be controlled on the printhead side based upon a discharge image signal.

According to a first aspect of the present invention there is provided a printing apparatus comprising: a printhead, which has a heater board on which heaters are disposed, configured to discharge ink; a transfer unit configured to transfer a discharge image signal to the printhead; and a power supply circuit configured to generate power for heating the heaters; wherein the printhead includes a supply circuit which, based upon the discharge image signal, supplies the heater board with power generated by the power supply circuit.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention, and together with the description, serve to explain the principles of the invention.

DESCRIPTION OF THE EMBODIMENTS

An exemplary embodiment(s) of the present invention will now be described in detail with reference to the drawings. It should be noted that the relative arrangement of the components, the numerical expressions and numerical values set forth in these embodiments do not limit the scope of the present invention unless it is specifically stated otherwise.

Note that the following description will exemplify a printing apparatus which adopts an ink-jet printing system. The printing apparatus may be, for example, a single-function printer having only a printing function, or a multifunction printer having a plurality of functions including a printing function, FAX function, and scanner function. Also, the printing apparatus may be, for example, a manufacturing apparatus used to manufacture a color filter, electronic device, optical device, micro-structure, and the like using a predetermined printing system.

In this specification, "printing" means not only forming significant information such as characters or graphics but also forming, for example, an image, design, pattern, or structure on a printing medium in a broad sense regardless of whether the formed information is significant, or processing the medium as well. In addition, the formed information need not always be visualized so as to be visually recognized by humans.

Also, a "printing medium" means not only a paper sheet for use in a general printing apparatus but also a member which can fix ink, such as cloth, plastic film, metallic plate, glass, ceramics, resin, lumber, or leather in a broad sense.

Also, "ink" should be interpreted in a broad sense as in the definition of "printing" mentioned above, and means a liquid which can be used to form, for example, an image, design, or pattern, process a printing medium, or perform ink processing upon being supplied onto the printing medium. The ink processing includes, for example, solidification or insolubilization of a coloring material in ink supplied onto a printing medium.

(First Embodiment)

Figure 1:
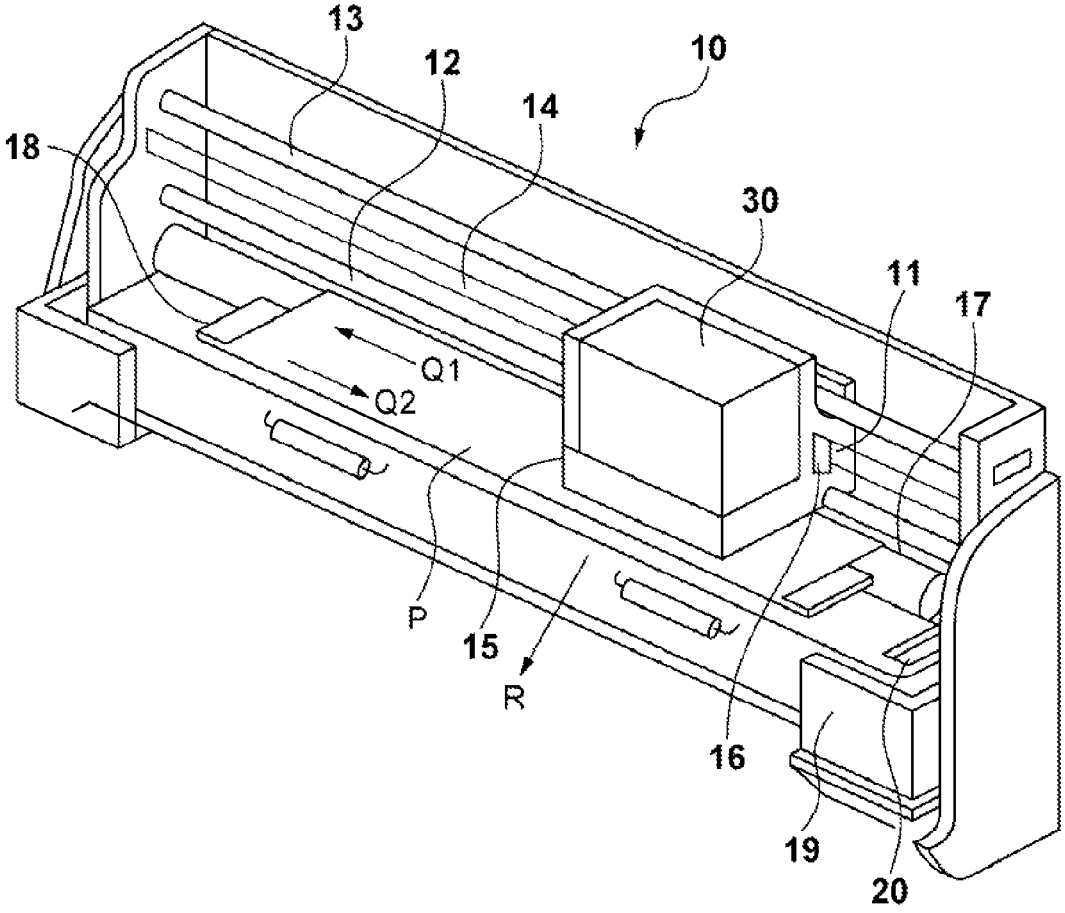
FIG. 1 is a diagram schematically illustrating the internal configuration of a printing apparatus 10 according to an embodiment of the present invention.

FIG. 1 is a diagram schematically illustrating the internal configuration of a printing apparatus according to an embodiment of the present invention.

An inkjet printing apparatus (referred to as a "printing apparatus" below) 10 includes a carriage 11 on which is mounted an inkjet printhead (referred to as a "printhead" below) 30 for printing by discharging ink in accordance with the inkjet method. The printing apparatus 10 carries out printing by causing the carriage 11 to move back and forth in directions indicated by arrows Q1 and Q2. The printing apparatus 10 conveys a printing medium P, such as printing paper, up to a print starting position. At the print starting position, the printing apparatus 10 prints by discharging ink toward the printing medium P from the printhead 30.

The printhead 30 is provided with one or a plurality of nozzles for discharging ink. In this embodiment, the printhead 30 is provided with 640 nozzles per ink color. The 640 nozzles provided for each color are divided into groups of 20 each driven in time-shared fashion. Each nozzle is provided with a heat generation element (referred to as a "heater" below). That is, the printhead 30 according to this embodiment employs an inkjet method of the type that discharges ink utilizing thermal energy.

An encoder film 14 is used to set the timing at which printing is performed by the printhead 30. An optical sensor 15 is placed on a side face of the carriage 11 and is used to measure the distance to the printing medium P every printing scan.

A conveyance roller 17 conveys the printing medium P in a direction (the direction indicated by arrow R, which is a sub-scanning direction) substantially perpendicular to a main-scanning direction (direction indicated by arrows Q1 and Q2). A platen 18 supports the printing medium P from below.

A maintenance apparatus 19 performs operations such as capping of the printhead 30, cleaning of the ink-discharge surface of the head and printhead recovery. A cap 20 caps the printhead 30. By thus hermetically sealing the nozzles of the printhead 30, drying of the ink inside the nozzles can be prevented.

By virtue of the arrangement described above, when a printing operation is performed, the printing medium P is fed by a feeding roller (not shown) and is further conveyed by the conveyance roller 17 to a predetermined print starting position. The printing medium P conveyed by the conveyance roller 17 to an area where printing is possible is supported from below by the platen 18.

The printing apparatus 10 causes the carriage 11 to move back and forth in the main-scanning direction (direction indicated by arrows Q1 and Q2) and causes ink to be discharged from the nozzles of printhead 30, which is mounted on the carriage 11, toward the printing medium P situated below the printhead nozzles. As a result, a single printing scan is carried out.

When the single printing scan ends, the printing apparatus 10 uses the conveyance roller 17 to convey the printing medium P a fixed amount along the sub-scanning direction (the direction indicated by arrow R) and causes ink to be discharged from the nozzles of the printhead 30 in the manner described above. Printing is carried out by repeating these operations, namely the printing medium conveyance operation and the printing operation performed by the printhead. When printing is performed, the printing apparatus 10 measures the distance between the printhead 30 and the printing medium using the optical sensor 15 mounted on the carriage 11 and reads slits in the encoder film 14 using an encoder sensor 16 mounted on the carriage 11. In this way the timing at which printing is performed by the printhead 30 is decided.

Figure 2:
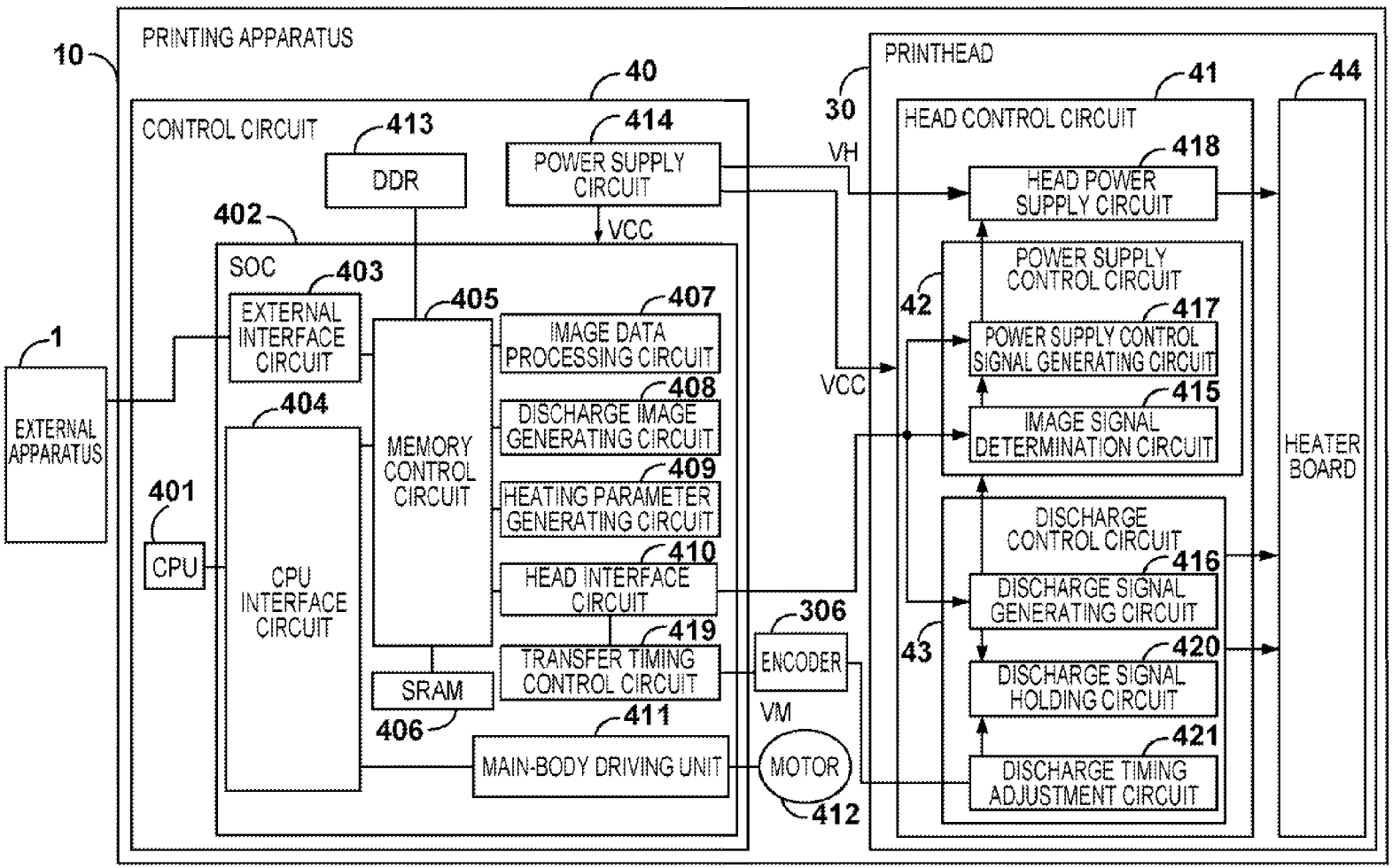
FIG. 2 is a diagram illustrating an example of the functional configuration of the printing apparatus 10 shown in FIG. 1.

Next, reference will be had to FIG. 2 to describe an example of the functional configuration of the printing apparatus 10 shown in FIG. 1.

An external apparatus 1 will be described first. The external apparatus 1 is, for example, a personal computer or a hard-disk drive (HDD) or the like. The external apparatus 1 functions so as to furnish the printing apparatus 10 with image data that is to be printed.

The configuration of the printing apparatus 10 will be described next. The printing apparatus 10 is provided with a control circuit 40, which performs overall control of processing in the printing apparatus 10, and with the printhead 30. The printhead 30 is provided with a head control circuit 41 for controlling the printhead 30 and a heater board 44 on which one or a plurality of headers are arrayed. The heater board 44 has a driving circuit for driving the heaters.

The control circuit 40 is provided with a CPU 401, an SOC 402, a DDR (Double-Data-Rate Synchronous Dynamic Random Access Memory) 413 and a power supply circuit 414.

The power supply circuit 414 supplies power to each of the components of the apparatus. More specifically, the power supply circuit 414 supplies power to each of the components of printing apparatus 10 after applying a voltage conversion to power that has been input externally. For example, the power supply circuit 414 generates the power (VCC) for operating logic circuitry, motor driving power (VM), head driving power (VH) and the like.

The CPU 401 controls each of the components in the printing apparatus 10. The SOC 402 controls hardware specific to the printing apparatus 10, and the DDR 413 is a reception buffer attached externally to the SOC 402. Image data that has undergone image processing is stored in the DDR 413.

The SOC 402 is provided with an external interface (I/F) circuit 403, a CPU interface circuit 404, a memory control circuit 405, an SRAM (Static Random-Access Memory) 406, an image data processing circuit 407 and a discharge image generating circuit 408. The SOC 402 is further provided with a heating parameter generating circuit 409, a head interface circuit 410, a driving circuit 411 for the main body of the apparatus, and a transfer timing control circuit 419.

The external interface circuit 403 is an interface for administering communication between the printing apparatus 10 and the external apparatus 1. Examples of the external interface circuit 403 are a USB (Universal Serial Bus) interface circuit, a LAN (Local-Area Network) interface circuit and an IDE interface circuit and the like.

The CPU interface circuit 404 is connected to a CPU (Central Processing Unit) and administers communication between the CPU and each component.

The memory control circuit 405 exercises of control of various data between the SRAM 406 and each component. The memory control circuit 405 transfers image data, which enters from the external apparatus 1, to the SRAM 406, by way of example. Further, the memory control circuit 405 controls the reading and writing of data from and to the DDR 413.

The SRAM 406 is utilized as a work buffer. For example, image data is stored in the SRAM 406 upon being divided into a specific size. The number of SRAMs may be equivalent to the number of colors or equivalent to the number of nozzles and can be changed appropriately.

The image data processing circuit 407 applies image processing to image data that has been stored in the SRAM 406. Examples of image processing include an HV conversion, smoothing and discharge failure complement but is not limited to these.

The discharge image generating circuit 408 converts image data that has undergone image processing to data (referred to as "discharge image data" below) in a form conforming to the nozzles of the printhead 30. The heating parameter generating circuit 409 generates a parameter (referred to as a "heating parameter" below) of a discharge control signal (heating pulses) that controls the heaters of the printhead 30. It should be noted that a heating pulse is a signal that regulates the heating time (heat-generating time) of the heater. Power VH conforming to the heating time is applied to the heater, thereby causing the heater to emit heat.

The transfer timing control circuit 419 generates a signal (a transfer timing signal) indicating the transfer timing of the discharge image data and heating parameter (a signal that is the result of manipulating the discharge image data and heating parameter shall be referred to as an "image signal"). The transfer timing signal is generated by frequency-multiplying the signal that is input by the encoder sensor 16.

The head interface circuit 410 processes the image signal and transfers a reference clock signal (referred to as a "CLK signal" below), a signal (referred to as a "LAT signal" below) that specifies timing at which discharge image data is accepted, and the image signal to the printhead 30 (head control circuit 41). Transfer of these signals is performed in accordance with the transfer timing signal generated by the transfer timing control circuit 419.

The driving circuit 411 for the main unit of the apparatus drives the motor 412 and controls sensors (not shown).

The head control circuit 41 will be described next. The head control circuit 41 comprises a head power supply circuit 418, a power supply control circuit 42 and a discharge control circuit 43.

The power supply control circuit 42 on/off controls supply of power (VH) to the heater board 44 based upon the image signal transferred by the head interface circuit 410. The power supply control circuit 42 is provided with an image signal determination circuit 415 and a power supply control signal generating circuit 417.

The image signal determination circuit 415 determines whether the image signal transferred by the head interface circuit 410 is normal or not. If the image signal is not normal, the image signal determination circuit 415 outputs an alert signal to the power supply control signal generating circuit 417. Data that is abnormal means data that has come to contain noise or from which data has been dropped in the course of being transferred between the head interface circuit 410 and a discharge signal generating circuit 416.

The power supply control signal generating circuit 417 generates a head power supply control signal (referred to as "VH_ENB" below) based upon the heating parameter of the image signal transferred by the head interface circuit 410. Further, the power supply control signal generating circuit 417 analyzes the heating parameter and, if a valid heating pulse has been transferred, turns on VH_ENB. On the other hand, if the heating time decided in accordance with the heating pulse is longer than stipulated, or if the pulse differs from an expected pulse owing to noise or the like, the power supply control signal generating circuit 417 turns off VH_ENB.

The head power supply circuit 418 switches between the on and off states of VH, which is output from the power supply circuit 414, in accordance with the logic (ON or OFF) of VH_ENB that is output by the power supply control signal generating circuit 417. In other words, the head power supply circuit 418 and power supply control circuit 42 constitute a supply circuit for supplying the heater board with power VH generated by the power supply circuit 414. Although the head power supply circuit 418 preferably is constituted by FETs (Field-Effect Transistors) or the like, it is not limited to such an arrangement.

The discharge control circuit 43 controls discharge of ink from one or a plurality of nozzles based upon the image signal transferred by the head interface circuit 410. The discharge control circuit 43 is provided with a discharge signal generating circuit 416, a discharge signal holding circuit 420 and a discharge timing adjustment circuit 421.

The discharge signal generating circuit 416 expands the image signal transferred by the head interface circuit 410 and generates discharge image data and a heating pulse. Further, the discharge signal generating circuit 416 transfers the CLK signal and LAT signal, which are transferred by the head interface circuit 410, to the heater board 44. The driving circuit provided on the heater board 44 drives the heater based upon the discharge image data and heating pulse.

The discharge signal holding circuit 420 holds the discharge image data and heating pulse generated by the discharge signal generating circuit 416. It should be noted that the discharge signal holding circuit 420 is a FIFO (First In, First Out) buffer having a memory array and pointers (see FIG. 7, described later).

The discharge timing adjustment circuit 421 frequency-multiplies the signal that is input by the encoder sensor 16 and generates a discharge timing signal. The discharge timing adjustment circuit 421 adjusts the relationship between discharge position and discharge data and outputs the discharge timing signal to the discharge signal holding circuit 420 at a prescribed timing. As a result, the discharge signal holding circuit 420 transfers the discharge image data and heating pulse to the heater board 44 based upon this signal.

Next, an example of the flow of operation of the printing apparatus 10 shown in FIG. 1 will be described with reference to FIG. 3. Here the flow of processing up to discharge of ink will be described.

First, the printing apparatus 10 receives image data from the external apparatus 1 using the external interface circuit 403 (step S101). The printing apparatus 10 then writes this received image data to the SRAM 406 using the memory control circuit 405 (step S102).

When image data is written to the SRAM 406, the printing apparatus 10 applies image processing to this image data using the image data processing circuit 407 (step S103).

When the image processing is completed, the printing apparatus 10 uses the memory control circuit 405 to read out the image data, which has undergone image processing, in increments of a specific unit (256 bits, by way of example) (step S104). The image data that has been read out (256 bits at a time) is transferred to the DDR 413 (step S105).

Next, using the discharge image generating circuit 408, the printing apparatus 10 generates data (discharge image data), which has a format conforming to the shape of the nozzles of the printhead 30, based upon the data that has been transferred to the DDR 413 (step S106). Using the heating parameter generating circuit 409, the printing apparatus 10 generates a heating parameter taking into consideration the image data, ambient temperature and head temperature (step S107). The printing apparatus 10 transfers the image signal (discharge image data and heating parameter) to the head control circuit 41 using the head interface circuit 410 (step S108).

Using the image signal determination circuit 415, the printing apparatus 10 analyzes the image signal and determines whether this image signal is normal or not. If the signal is not normal, the printing apparatus 10 outputs an alert signal to the power supply control signal generating circuit 417 (step S109).

Next, using the power supply control signal generating circuit 417, the printing apparatus 10 generates the power supply control signal VH_ENB based upon the heating parameter of the image signal transferred from the head interface circuit 410 (step S110). If VH_ENB is "1" and VH is being applied by the power supply circuit 414, then VH is supplied to the heater board 44 by the head power supply circuit 418 (step S111).

The printing apparatus 10 expands the image signal, which has been transferred from the head interface circuit 410, using the discharge signal generating circuit 416 (step S112) and transfers this expanded image signal to the discharge signal holding circuit 420 as discharge image data and a heating pulse (step S113). Using the discharge timing adjustment circuit 421, the printing apparatus 10 transfers the image data and heating pulse from the discharge signal holding circuit 420 to the heater board 44 in accordance with discharge timing signal (step S114). As a result, ink is discharged from one or a plurality of nozzles on the heater board 44 (step S115).

Figure 4A:
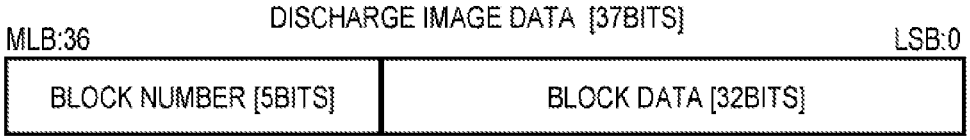
FIG. 4A is a diagram illustrating an example of the bit structure of discharge image data.
Figure 4B:
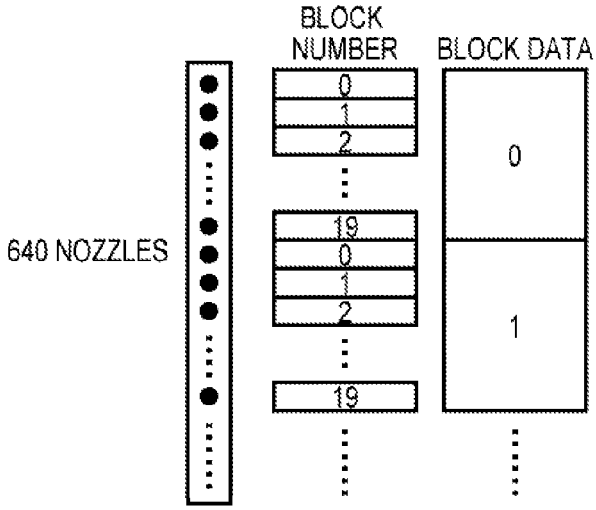
FIG. 4B is a diagram illustrating an example of a nozzle row in pictorial form.
Figure 4C:
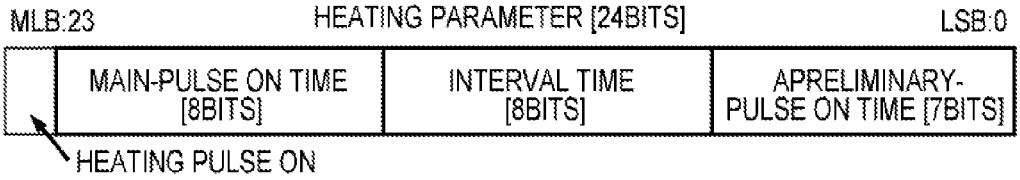
FIG. 4C is a diagram illustrating an example of the bit structure a heating parameter.
Figure 4D:
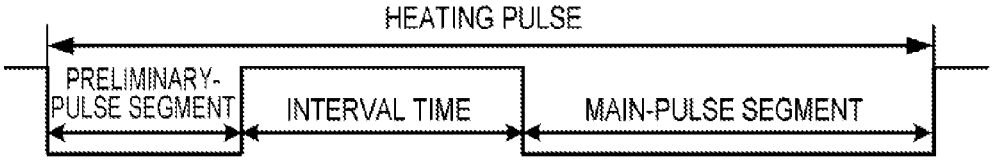
FIG. 4D is a diagram illustrating an example of a setting of heating pulses generated by a heating parameter.
Figure 4E:
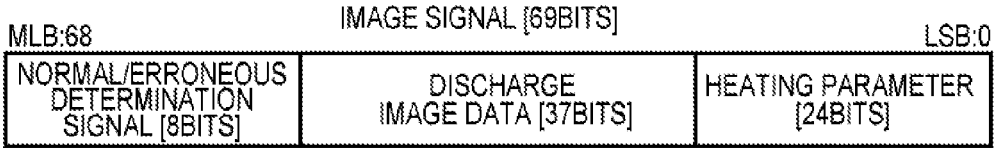
FIG. 4E is a diagram illustrating an example of the bit structure of an image signal.

An example of the composition of discharge image data, heating parameter and image signal will be described with reference to FIGS. 4A to 4E. FIG. 4A is a diagram illustrating an example of the bit structure of the discharge image data, FIG. 4B is a diagram illustrating an example of a nozzle row in pictorial form, FIG. 4C is a diagram illustrating an example of the bit structure the heating parameter, FIG. 4D is a diagram illustrating an example of a setting of heating pulses generated by the heating parameter, and FIG. 4E is a diagram illustrating an example of the bit structure of an image signal.

In this embodiment, as set forth above, the printhead 30 is provided with 640 nozzles per ink color, and these 640 nozzles are divided into blocks of 20 nozzles driven in time-shared fashion. Further, how the 640 nozzles are driven is controlled by the discharge image generating circuit 408.

As shown in FIG. 4A, the discharge image data is composed of a 5-bit block number and 32-bit block data, for a total of 37 bits. The discharge image data will be described using the pictorial image of the nozzle row shown in FIG. 4B. The 640 nozzles are divided into 20 blocks of Block Nos. 0 to 19. Each block is composed of 32 nozzles. A block of blocks 0 to 19 is selected from among the five bits of block numbers of the discharge image data, and from which nozzles of a certain block ink is discharged is selected from among the 32 bits of block data.

The heating parameter will be described next. The heating parameter generated by the heating parameter generating circuit 409 is indicated by the bit structure shown in FIG. 4C. Specifically, the heating parameter is composed of 7 bits for preliminary-pulse ON time, 8 bits for interval time, 8 bits for main-pulse ON time and 1 bit for setting ON/OFF of the heating pulse, for a total of 24 bits.

Assume that a heating pulse is LOW active. In this case, the heating pulse has the structure shown in FIG. 4D Here a preliminary-pulse segment of 7 bits for preliminary-pulse ON time, an interval segment of 8 bits for interval time and a main-pulse segment of 8 bits for main-pulse ON time are set. As a result, during the time that a preliminary pulse and a main pulse are ON, voltage is applied only to the heaters of nozzles of the printhead 30 that are ON in a certain block.

The image signal will be described next. The image signal has the bit structure shown in FIG. 4E. In the head interface circuit 410, the image signal is constituted by a signal of a total of 69 bits inclusive of a heating parameter, discharge image data and an 8-bit normal/erroneous determination signal (normal/erroneous determination data). In a case where the connection between the control circuit 40 and head control circuit 41 is taken into account, it is preferred that the image signal be transferred serially. In a case where the image signal is transferred serially, the transfer is performed in order starting from the LSB.

Next, the determination by the image signal determination circuit 415 as to whether the image signal is normal or erroneous will be described. The image signal determination circuit 415 determines whether the image signal is normal or erroneous using the eight bits of the normal/erroneous determination signal appended to the image signal.

The normal/erroneous determination signal is set to a fixed value and is appended to the image signal as, e.g., "10101010" or the like. The image signal determination circuit 415 determines whether the normal/erroneous determination signal is the correct value whenever an image signal is transferred from the head interface circuit 410.

If the result of the determination is that the normal/erroneous determination signal does not indicate the correct value, the image signal determination circuit 415 outputs the alert signal to the power supply control signal generating circuit 417 to thereby notify of the fact that a normal image signal has not been transferred for some reason.

It should be noted that the method of determining whether the image signal is normal or erroneous is not limited to that described above. For example, it may be arranged so that, upon receiving the image signal from the head interface circuit 410, the image signal determination circuit 415 requests the head interface circuit 410 to resend the signal and the head interface circuit 410 and a signal comparison is performed in the head interface circuit 410. In this case, the head interface circuit 410 sends the image signal determination circuit 415 the result of whether the image signal is normal or abnormal.

Figure 5:
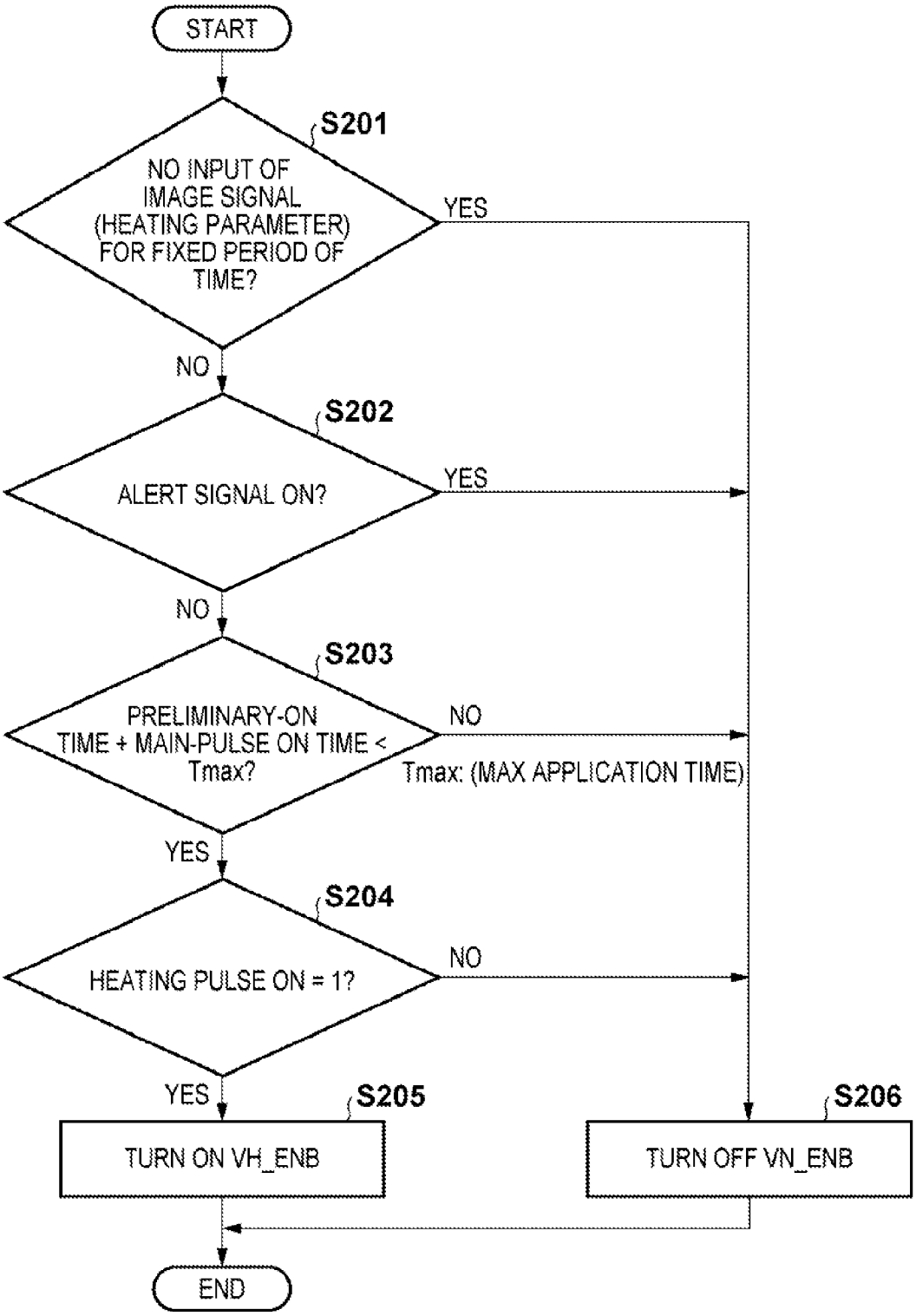
FIG. 5 is a flowchart illustrating an example of the flow of operation of a power supply control signal generating circuit 417 shown in FIG. 2.

FIG. 5 will be described with regard to an example of the flow of operation in the power supply control signal generating circuit 417 shown in FIG. 2. Here the flow of processing for controlling the power supply will be described.

When an image signal (heating parameter) is transferred by the head interface circuit 410 ("NO" at step S201), the power supply control signal generating circuit 417 starts processing. It should be noted that if an image signal is not transferred for a fixed period of time ("YES" at step S201), the power supply control signal generating circuit 417 determines that the printing operation has ended and turns of VH_ENB (step S206). That is, the power supply control signal generating circuit 417 cuts off the supply of VH to the heater board 44.

If the image signal is not normal, an alert signal is input to the power supply control signal generating circuit 417 from the image signal determination circuit 415 ("YES" at step S202). In this case, the power supply control signal generating circuit 417 turns off VH_ENB (step S206). If the image signal is normal, i.e., if the alert signal is not being input from the image signal determination circuit 415 ("NO" at step S202), the power supply control signal generating circuit 417 determines whether the total of preliminary-pulse ON time and main-pulse ON time is within a predetermined length of time. The total of the preliminary-pulse ON time and main-pulse ON time indicates the duration of header ON time. It should be noted that the reason why the predetermined length of time (maximum application time Tmax) has been set is to prevent failure of the heater board 44 owing to a pulse longer than expected being applied to the heater.

If the total of preliminary-pulse ON time and main-pulse ON time is equal to or greater than maximum application time (equal to or greater than a predetermined length of time) ("NO" at step S203), then the power supply control signal generating circuit 417 turns off VH_ENB (step S206). Otherwise ("YES" at step S203), the power supply control signal generating circuit 417 checks the setting of heating pulse ON of the heating parameter. It should be noted that in the case of heating pulse ON, this indicates that the heating parameter is valid. In case of heating pulse OFF, this indicates that the heating parameter is invalid.

If heating pulse ON="1" holds ("YES" at step S204), the power supply control signal generating circuit 417 turns on VH_ENB (step S205). Further, if heating pulse ON="0" holds ("NO" at step S204), then the power supply control signal generating circuit 417 turns of VH_ENB (step S206). What can be considered, by way of example, as a case where heating pulse ON="0" is input is one where a driving portion of the main body of the apparatus, such as the carriage 11 thereof, develops an abnormality and it has become necessary to cut off VH immediately.

Thus, the power supply control signal generating circuit 417 controls VH_ENB in synch with the image signal. As a result, VH can be cut off immediately in conformity with a variety of conditions.

Figure 6:
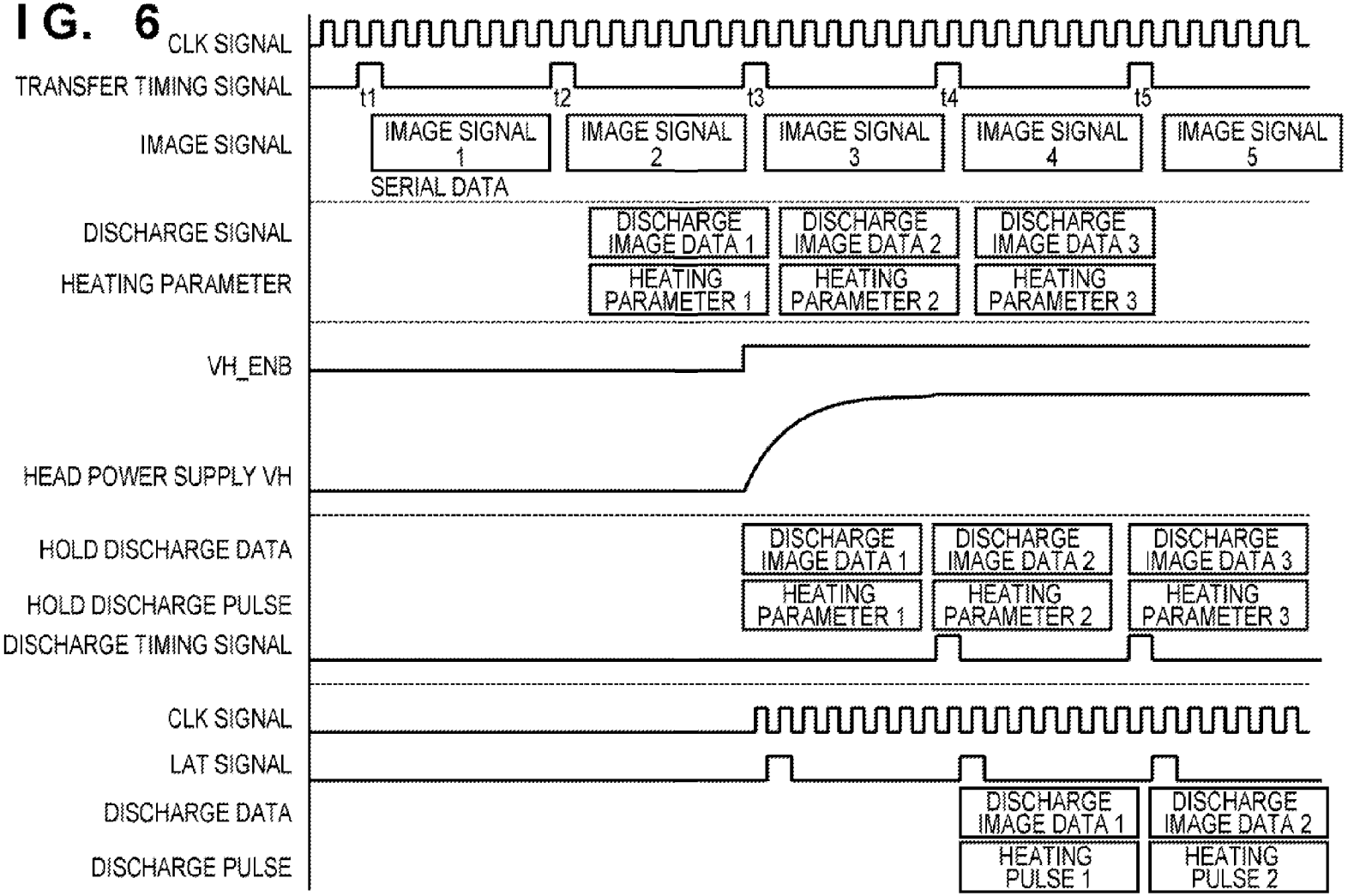
FIG. 6 is a diagram illustrating an example of processing timing of an image signal of the printing apparatus 10 shown in FIG. 1.

FIG. 6 is a diagram illustrating an example of timing of processing of the image signal in the printing apparatus 10 shown in FIG. 1. FIG. 6 describes the timing up to transfer of discharge image data and heating parameter from the head interface circuit 410 to the printhead 30.

It should be noted that after VH_ENB turns on, some time is required for VH to reach and stabilize at the predetermined voltage. Since the length of this time differs depending upon the voltage of VH and the circuit arrangement, here it is assumed to be one period of the transfer timing signal. In this case, since it takes one period of the transfer timing signal until the voltage of VH stabilizes, a timing adjustment is performed by sending the image signal to the head control circuit 41 at a timing more than one period earlier than the discharge timing (namely a timing earlier than the time needed for the voltage of VH to stabilize).

First, the transfer timing control circuit 419 outputs a transfer timing signal obtained by frequency-multiplying the encoder signal by N, and the head interface circuit 410 transfers the image signal to the printhead 30 serially in accordance with this timing. Here an image signal 1 is serially transferred at a timing t1.

The image signal 1 serially transferred from the head interface circuit 410 is latched in the discharge signal generating circuit 416 at a timing t2 and discharge image data 1 and a heating parameter 1 are generated by the discharge signal generating circuit 416. Since the period of the image signal is clearly smaller than the signal period of transfer timing, the generation of the discharge image data 1 and heating parameter 1 is completed before a timing t3.

If the image signal exhibits no abnormality, the power supply control signal generating circuit 417 turns on VH_ENB at the timing (t3) of the next transfer timing signal. As a result, VH is supplied from the head power supply circuit 418 to the printhead 30.

Further, at timing t3, the discharge signal holding circuit 420 holds the discharge image data 1 and heating parameter 1 generated by the discharge signal generating circuit 416. The discharge image data 1 and heating parameter 1 are transferred to the printhead 30 in accordance with the discharge timing signal transmitted from the discharge timing adjustment circuit 421.

Based upon the discharge image data and heating pulse transferred to the printhead 30, ink is thenceforth discharged from one or a plurality of nozzles formed in the heater board 44. The discharge of the ink is carried out in accordance with the timings of the CLK signal and LAT signal.

Figure 7:
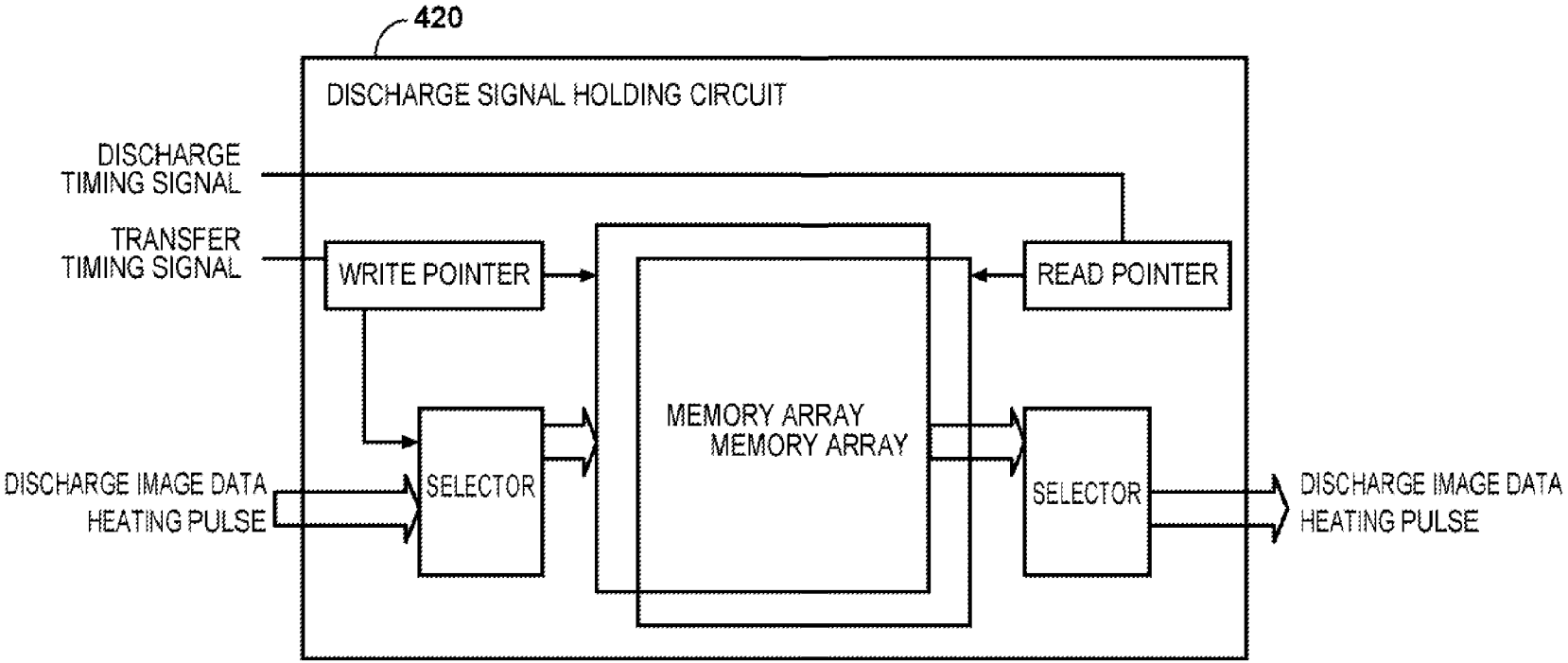
FIG. 7 is a diagram illustrating an example of the configuration of a discharge signal holding circuit 420 shown in FIG. 2.

As illustrated in FIG. 7, the discharge signal holding circuit 420 is a FIFO buffer having a memory array and pointers. If VH_ENB has been turned on and the transfer timing signal entered, then the discharge image data and heating parameter generated by the discharge signal generating circuit 416 are stored in the memory array. When the discharge timing signal enters from the discharge timing adjustment circuit 421, the discharge image data and heating parameter that have been stored in the memory array are transferred to the printhead 30. The number of discharge signals held can be adjusted by the number of stages of the memory array.

The description rendered above assumes that it takes one period of the transfer timing until the voltage of VH stabilizes. However, it may be arranged so that the image signal is transferred to the printhead 30 (head control circuit 41) before the voltage of VH stabilizes. In such case the image signals generated by the discharge signal generating circuit 416 are held in the discharge signal holding circuit 420. Even in the case of such an arrangement, the discharge signal holding circuit 420 can transfer the image signals to the printhead 30 in order starting from the oldest signal. This means that the above-described processing can be implemented irrespective of stabilization time of VH.

Further, in the description rendered above, a case is described in which, in order to adjust the timing up to stabilization of the voltage of VH, the image signal is transferred to the printhead 30 (head control circuit 41) at a timing obtained by reckoning backward from the time for stabilization of the voltage. However, this does not impose a limitation. For example, a method is also conceivable in which, by transferring dummy discharge image data and a dummy heating parameter (no discharge of ink) to the head control circuit 41, VH is turned on before the printing operation actually starts.

In accordance with the embodiment as described above, ON/OFF control of VH can be performed on the printhead side based upon the image signal (discharge image data and heating parameter). As a result, since VH can be applied immediately before ink is discharged by the printhead 30, power consumption can be reduced. Further, on the printhead side, VH can be controlled efficiently in a case where an illegal input has been input and in a case where an image signal has not been input over a fixed period of time.

(Second Embodiment)

A second embodiment will be described next. In the first embodiment, an arrangement in which ON/OFF control of VH is carried out in accordance with the image signal has been described. In the second embodiment, on the other hand, a case where the voltage of VH is controlled in accordance with the image signal will be described. It should be noted that the configuration of the printing apparatus 10, the data structure and the flow of processing are similar to those of the first embodiment. The description that follows will emphasize aspects of the second embodiment that differ from those of the first embodiment.

Figure 8:
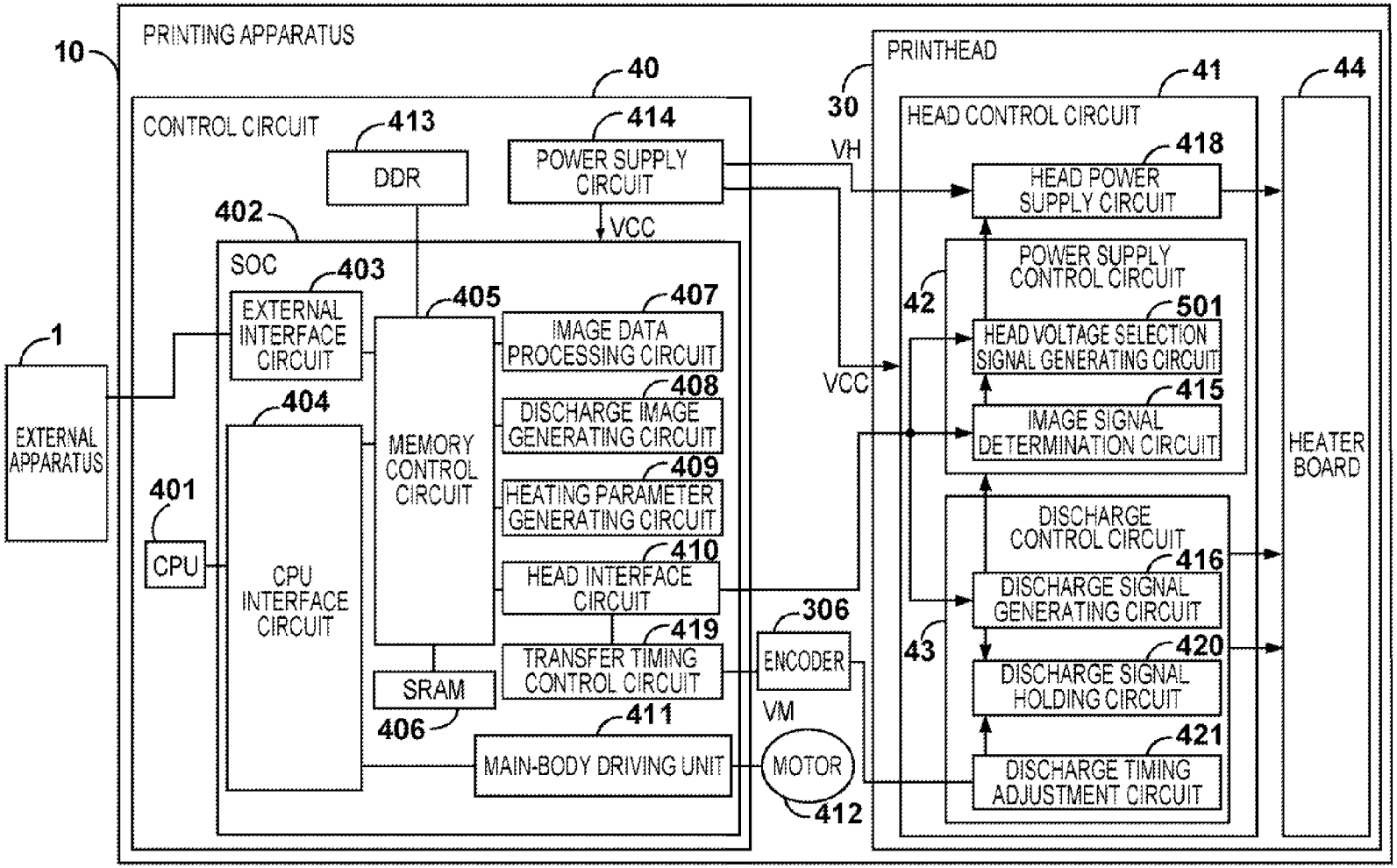
FIG. 8 is a diagram illustrating an example of the functional configuration of the printing apparatus 10 in a second embodiment.

FIG. 8 is a diagram illustrating an example of the functional configuration of the printing apparatus 10 in the second embodiment. It should be noted that components similar to those in FIG. 2 described above in the first embodiment are designated by like reference characters and need not be described again.

The head power supply circuit 418 provided within the head control circuit 41 according to the second embodiment is adapted so as to be capable of generating voltages in a plurality of steps (64 steps, for example). More specifically, the voltage of VH supplied from the power supply circuit 414 is changed over in accordance with a head voltage selection signal from a head voltage selection signal generating circuit 501. The head power supply circuit 418 according to the second embodiment preferably comprises a DC/DC converter or the like but is not limited to such an arrangement.

Further, the head voltage selection signal generating circuit 501 is newly provided within the head control circuit 41. The head voltage selection signal generating circuit 501 selects the voltage of the head driving power (VH) based upon the image signal transferred by the head interface circuit 410. As a result, the head voltage selection signal generating circuit 501 outputs the head voltage selection signal to the head power supply circuit 418. Thus, in the head control circuit 41 according to the second embodiment, the voltage of VH can be changed dynamically based upon the image signal.

By way of example, when the supply of VH to the heater board 44 is turned off in the first embodiment, VH having a voltage value of a level at which ink is not discharged from a nozzle is supplied to the header board. Further, when the supply of VH to the heater board 44 is turned on in the first embodiment, the voltage value of VH is placed at a level at which ink is discharged from the nozzle in the second embodiment. Although the details will be described later, in a case where the voltage value of VH is placed at a level at which ink is discharged from a nozzle, the voltage value of VH is decided based upon the number of nozzles (the dot-count value) for which discharge is instructed by the discharge image data included in the image signal.

Figure 3:
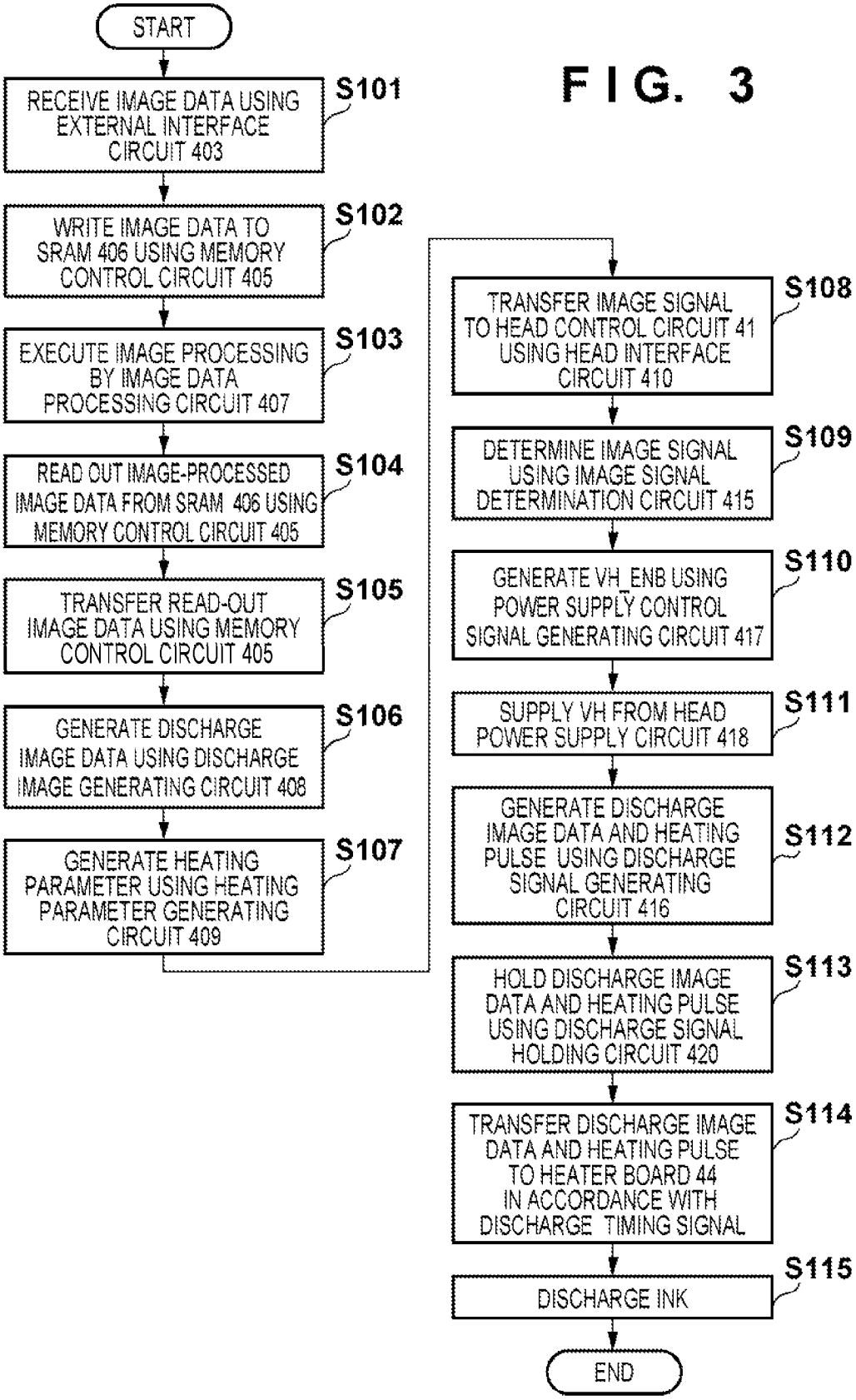
FIG. 3 is a flowchart illustrating an example of the flow of operation of the printing apparatus 10 shown in FIG. 1.

Since processing in the printing apparatus 10 of the second embodiment when ink is discharged is similar to the flow of processing shown in FIG. 3 described above in conjunction with the first embodiment, here a description using drawings is omitted. Briefly, the second embodiment differs from the first embodiment as follows: In the processing of step S110, the head voltage selection signal generating circuit 501 generates the head voltage selection signal based upon the image signal that has been transferred from the head interface circuit 410. In the processing of step S111, the head power supply circuit 418 applies VH, which has a voltage value selected by the head voltage selection signal, to the heater board 44 while VH is being applied by the power supply circuit 414.

Figure 9A:
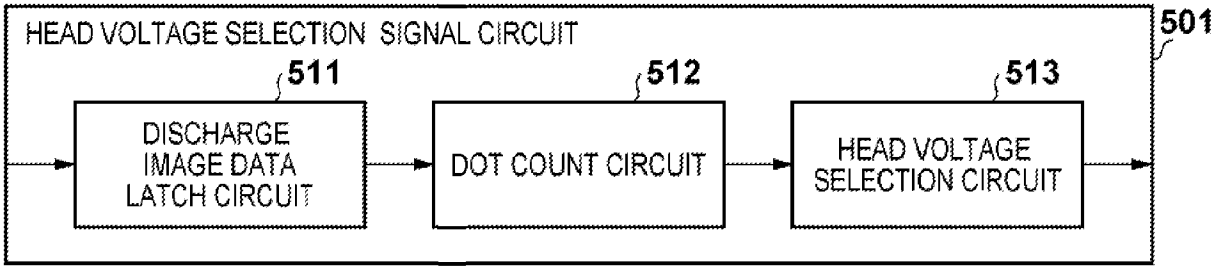
FIGS. 9A and 9B are diagrams illustrating examples of functional configurations of a head voltage selection signal generating circuit 501 shown in FIG. 8.

Next, reference will be had to FIG. 9A to describe an example of the functional configuration of the head voltage selection signal generating circuit 501 shown in FIG. 8.

The head voltage selection signal generating circuit 501 is provided with a discharge image data latch circuit 511, a dot count circuit 512 and a head voltage selection circuit 513, as shown in FIG. 9A.

When processing in the head voltage selection signal generating circuit 501 starts, first the discharge image data latch circuit 511 latches the image signal that has been transferred from the head interface circuit 410 and generates the discharge image data. As shown in FIG. 4A described above in conjunction with the first embodiment, the discharge image data is composed of a block number and block data. As set forth above, the total of the number of dots (the number of nozzles instructed to discharge ink) of this block data is the number of dots discharged a single time.

Next, the dot count circuit 512 counts the number of dots of block data. (The number of dots counted will be referred to as the "dot-count value" below.) The dot-count value is output to the head voltage selection circuit 513.

The head voltage selection circuit 513 is provided internally with a table in which dot-count values and voltages of VH have been correlated. This table is capable of being changed in the manner of software. Based upon the table, the head voltage selection circuit 513 outputs to the head power supply circuit 418 a head voltage selection signal conforming to the dot-count value from the dot count circuit 512. For example, in a case where the dot-count value is large, it will suffice to enlarge the voltage value of VH supplied to the heater board 44.

Figure 9B:
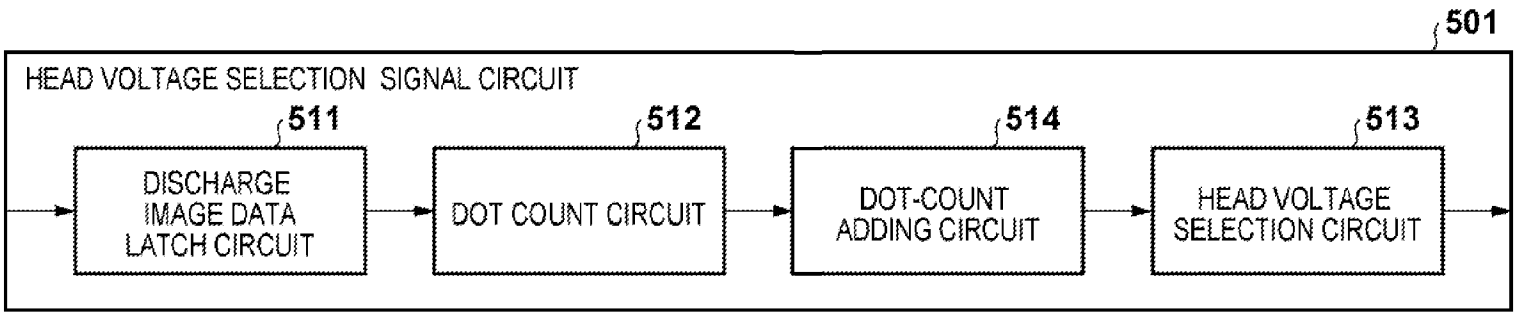

In the description rendered above, the dot-count value used in deciding VH is the total of a single item of discharge image data. However, this does not impose a limitation. That is, as shown in FIG. 9B, an arrangement may be adopted in which a dot-count adding circuit 514 is provided and the voltage of VH is changed based upon dot-count values obtained over a plurality of times.

Figure 9C:
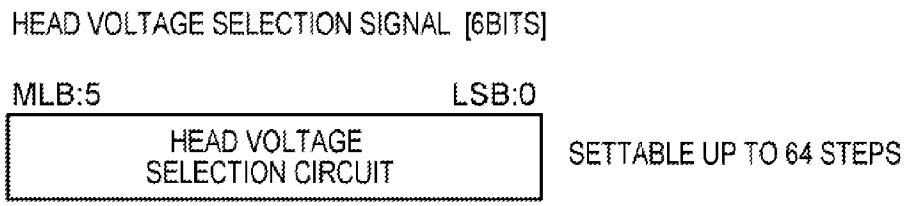
FIG. 9C is a diagram illustrating examples of configuration of a head voltage selection signal.

The head voltage selection signal is composed of six bits, as illustrated in FIG. 9C. This means that it is possible to change voltage in 64 steps, by way of example.

Figure 10:
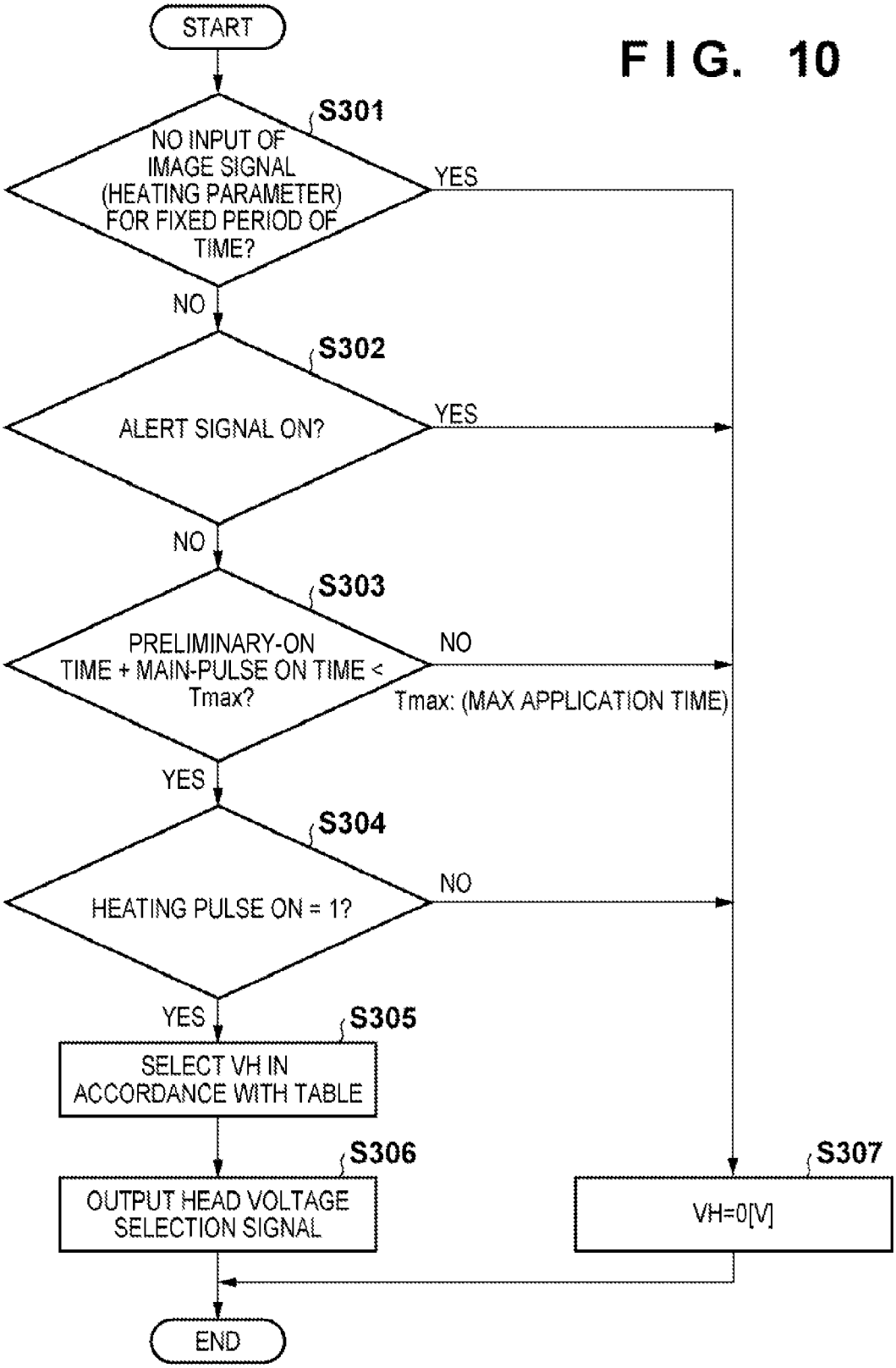
FIG. 10 is a flowchart illustrating an example of the flow of operation of the head voltage selection signal generating circuit 501 shown in FIG. 8.
Figure 11:
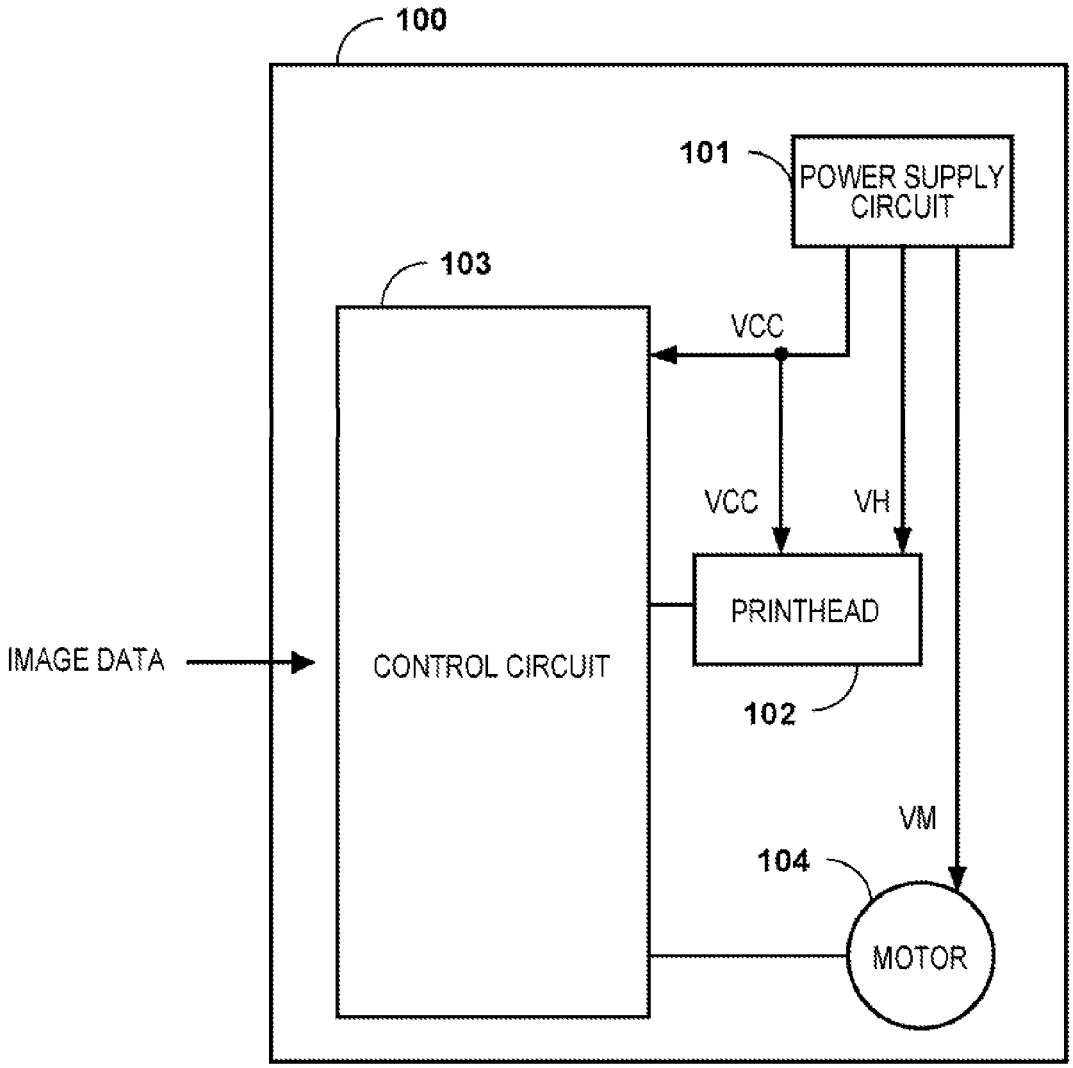
FIG. 11 is a diagram illustrating an example of the prior art.

Next, reference will be had to FIG. 10 to describe an example of the flow of operation in the head voltage selection signal generating circuit 501 shown in FIG. 8. Here the flow of processing for controlling the power supply will be described. It should be noted that since the processing of steps S301 to S304 is similar to the processing of steps S201 to S204 in the power supply control signal generating circuit 417 described above with reference to FIG. 5 in the first embodiment, this processing need not be described again. It should be noted that in the processing of step S307, VH is made 0 V as an example of a voltage value of a level at which ink is not discharged from a nozzle. Essentially, however, this has the same meaning as turning off VH_ENB.

At step S304, if heating pulse ON=1 holds ("YES" at step S304), the head voltage selection signal generating circuit 501 selects a voltage, which conforms to the dot-count value of the discharge image data, based upon the internal table of circuit 501 (step S305). The head voltage selection signal generating circuit 501 outputs the head voltage selection signal to the head power supply circuit 418 (step S306).

In accordance with the second embodiment, as described above, the voltage (voltage value) of VH can be controlled dynamically on the printhead side based upon the image signal (discharge image data and heating parameter). As a result, on the printhead side, VH can be controlled efficiently even in a case where an illegal input has been input and in a case where an image signal has not been input over a fixed period of time.

It should be noted that in the conventional arrangements, when the discharge image data will start and end cannot be determined on the printhead side even if the arrangement has a power supply circuit that is capable of controlling VH variably. Consequently, it becomes necessary in the prior art to change VH during the period of time in which VH is not being applied. As a consequence, it is difficult to change the voltage of VH dynamically in accordance with the image signal.

While the foregoing embodiments are examples of representative embodiments of the present invention, the present invention is not limited to the embodiments described above and illustrated in the drawings. The present invention can be worked upon being suitably modified within limits that do not depart from the gist of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-052119, filed on Mar. 9, 2011, which is hereby incorporated by reference herein in its entirety.

What is claimed is:

1. A printing apparatus comprising:

a printhead configured to discharge ink and the printhead including a heater board on which heaters corresponding to nozzles for discharging ink and a driving circuit for driving each of the heaters are disposed;

a receiving unit configured to receive image data;

a generating unit configured to generate discharge image data for printing an image and control data for controlling the heaters, based on the received image data;

a transfer unit configured to transfer an image signal including the generated discharge image data and the generated control data to the printhead, the printhead comprising a discharge control unit configured to control discharge of ink from the nozzles of the printhead, by turning ON heaters based on discharge image data and control data obtained from the image signal transferred by the transfer unit;

a transfer timing control circuit configured to generate a transfer timing signal indicating a transfer timing of the image signal by the transfer unit;

a heater board power supply circuit configured to supply power to the heater board; and a power supply control unit configured to control power supply of the heater board power supply circuit to the heater board by controlling whether or not supplying a voltage to the heater board so as to activate the heater board, based on whether the transferred image signal satisfies a predetermined condition, wherein a plurality of periods which are divided by the transfer timing signal include a first period, a second period subsequent to the first period, and a third period subsequent to the second period, in the first period, the transfer unit transfers the image signal, in the second period, the discharge control unit obtains discharge image data and control data from the image signal transferred by the transfer unit in the first period, in the third period, the power supply control unit controls the power supply of the heater board power supply circuit to the heater board based on whether the transferred image signal satisfies the predetermined condition, and after the third period, the discharge control unit controls discharge of ink from the nozzles, based on discharge image data and control data obtained from the transferred image signal.

2. The apparatus according to claim 1, wherein the power supply control unit is further configured to cause the heater board power supply circuit not to turn ON the supply of power to the heater board in a case where the image signal is not transferred by the transfer unit for a predetermined period of time.

3. The apparatus according to claim 1, wherein the transfer unit is further configured to transfer the image signal earlier than an ink discharge timing, based on a length of time required for voltage applied to the heater board to attain a predetermined voltage following a start of the supply of power to the heater board.

4. The apparatus according to claim 1, wherein the transfer unit is further configured to transfer a dummy image signal including a dummy discharge image data that does not cause discharge of ink.

5. The apparatus according to claim 1, wherein the heater board power supply circuit has a function to generate a voltage in a plurality of steps.

6. The apparatus according to claim 1, wherein the power supply control unit is further configured to cause the heater board power supply circuit not to turn ON the supply of power generated by the heater board power supply circuit to the heater board in a case where a total ON time of the heaters specified by the control data included in the transferred image is not within a predetermined amount of time.

7. The apparatus according to claim 1, wherein the power supply control unit is further configured to cause the heater board power supply circuit not to supply the heater board with the power generated by the heater board power supply circuit in a case where it is determined that the control data included in the transferred image signal is invalid.

8. The apparatus according to claim 1, wherein the power supply control unit is further configured to control a voltage generated by the heater board power supply circuit based on the transferred image signal.

9. The apparatus according to claim 1, wherein the power supply control unit is further configured to control so as to supply the heater board with power having a voltage value at which ink is not discharged in a case where a total ON time of the heaters specified by the control data is not within a predetermined amount of time.

10. The apparatus according to claim 1, wherein the power supply control unit is further configured to not supply the heater board with power having a voltage value for discharging ink in a case where a total ON time of the heaters specified by the control data is not within a predetermined amount of time.

11. The apparatus according to claim 1, wherein the power supply control unit is further configured to not supply the heater board with power having a voltage value for discharging ink in a case where it is determined that the control data is invalid.

12. The apparatus according to claim 1, wherein the power supply control unit causes the heater board power supply circuit to turn ON the supply of power to the heater board, before the printhead starts discharging ink, based on the transferred image signal.

13. The apparatus according to claim 1, wherein the power supply control unit is further configured to cause the heater board power supply circuit not to turn ON the supply of power to the heater board in a case where the control data included in the transferred image signal does not satisfies a predetermined condition.

14. The apparatus according to claim 1, wherein the image signal further includes a normal/erroneous determination signal for determining whether the image signal is normal or not, and the power supply control unit is further configured to cause the heater board power supply circuit to turn ON or turn OFF the supply of power to the heater board, based on the normal/erroneous determination signal.

15. The apparatus according to claim 14, wherein the power supply control unit is further configured to cause the heater board power supply circuit to turn ON the supply of power to the heater board in a case where it is determined based upon the normal/erroneous determination signal that the discharge image data is normal.

16. The apparatus according to claim 14, wherein the power supply control unit is further configured to cause the heater board power supply circuit not to turn ON the supply of power to the heater board in a case where it is determined based upon the normal/erroneous determination signal that the discharge image data is erroneous.

17. The apparatus according to claim 14, wherein the power supply control unit is further configured to control so as to supply the heater board with power having a voltage value at which ink is not discharged in a case where it is determined based upon the normal/erroneous determination signal that the discharge image data is erroneous.

18. The apparatus according to claim 1, wherein the printhead includes the discharge control circuit, the heater board power supply circuit, and the power supply control unit.

19. The apparatus according to claim 1, wherein the power supply control unit causes the heater board power supply circuit to supply power having a voltage value for discharging ink to the heater board, before the printhead starts discharging ink, based on the transferred image signal.

20. The apparatus according to claim 1, wherein the power supply control unit causes the heater board power supply circuit not to supply power having a voltage value for discharging ink to the heater board in a case where the control data included in the transferred image signal does not satisfies a predetermined condition.

21. The apparatus according to claim 1, wherein the image signal further includes a normal/erroneous determination signal for determining whether the image signal is normal or not, and the power supply control unit controls the voltage which the heater board power supply circuit supplies to the heater board, based on the normal/erroneous determination signal.

22. The apparatus according to claim 1, wherein the power supply control unit causes the heater board power supply circuit to turn ON or turn OFF the supply of power to the heater board, based on whether the transferred image signal is normal or not.

23. The apparatus according to claim 1, wherein the control data included in the transferred image signal includes information for specifying whether the control data included in the transferred image signal is valid or not, and the power supply control unit causes the heater board power supply circuit to turn ON or turn OFF the supply of power to the heater board, based on the information.

24. The apparatus according to claim 1, wherein the power supply control unit controls a voltage value of the power supplied to the heater board by the heater board power supply circuit, based on whether the transferred image signal is normal or not.

25. The apparatus according to claim 1, wherein the control data included in the transferred image signal includes information for specifying whether the control data included in the transferred image signal is valid or not, and the power supply control unit controls a voltage value of the power supplied to the heater board by the heater board power supply circuit, based on the information.

26. The apparatus according to claim 1, wherein the power supply control unit includes a discharge signal holding circuit for holding in the third period the discharge image data and the control data obtained from the transferred image signal.

27. The apparatus according to claim 1, wherein the voltage supplied to the heater board by the heater board power supply circuit become stabilized before the fourth period.

28. A method of controlling a printing apparatus comprising a printhead configured to discharge ink, wherein the printhead includes a heater board on which heaters corresponding to nozzles for discharging ink and a driving circuit for driving each of the heaters are disposed, and a heater board power supply circuit configured to supply power to the heater board, the method comprising:

receiving unit image data;

generating discharge image data for printing an image and control data for controlling the heaters, based on the received image data;

transferring an image signal including the generated discharge image data and the generated control data to the printhead;

generating a transfer timing signal indicating a transfer timing for transferring the image signal in the transferring;

controlling discharge of ink from the nozzles of the printhead, by turning ON heaters based on discharge image data and control data obtained from the transferred image signal; and controlling power supply of the heater board power supply circuit to the heater board by controlling whether or not supplying a voltage to the heater board so as to activate the heater board, based on whether the transferred image signal satisfies a predetermined condition, wherein a plurality of periods which are divided by the transfer timing signal include a first period, a second period subsequent to the first period, and a third period subsequent to the second period, in the first period, the image signal is transferred, in the second period, discharge image data and control data are obtained from the image signal transferred in the first period, in the third period, the power supply of the heater board power supply circuit to the heater board is controlled, based on whether the image signal transferred in the first period satisfies the predetermined condition, and after the third period, discharge of ink from the nozzles is controlled based on discharge image data and control data obtained from the image signal transferred in the first period.

* * * * *